US009214076B2

(12) United States Patent
Curtis et al.

(10) Patent No.: US 9,214,076 B2
(45) Date of Patent: Dec. 15, 2015

(54) FIREFIGHTER'S SAFETY MONITORING AND ALARM

(71) Applicants: Mike Curtis, Newcastle, CA (US); Ron Cone, Orangevale, CA (US); Don Freels, Loomis, CA (US)

(72) Inventors: Mike Curtis, Newcastle, CA (US); Ron Cone, Orangevale, CA (US); Don Freels, Loomis, CA (US)

( * ) Notice: Subject to any disclaimer, the term of this patent is extended or adjusted under 35 U.S.C. 154(b) by 131 days.

(21) Appl. No.: 13/987,005

(22) Filed: Jun. 25, 2013

(65) Prior Publication Data

US 2014/0375459 A1 Dec. 25, 2014

(51) Int. Cl.

| | |
|---|---|
| ***G08B 23/00*** | (2006.01) |
| ***G08B 21/02*** | (2006.01) |
| ***G08B 21/04*** | (2006.01) |
| *G08B 25/01* | (2006.01) |

(52) U.S. Cl.

CPC ..... *G08B 21/02* (2013.01); *G08B 21/0415* (2013.01); *G08B 21/0446* (2013.01); *G08B 25/016* (2013.01)

(58) Field of Classification Search

CPC ..... G08B 21/0415; G08B 21/0446; G08B 25/016

USPC ..... 340/586, 573.1, 578, 539.1, 539.11, 340/539.13, 539.32

See application file for complete search history.

(56) References Cited

U.S. PATENT DOCUMENTS

| | | | | |
|---|---|---|---|---|
| 5,200,736 | A * | 4/1993 | Coombs | A42B 3/046 2/5 |
| 6,075,445 | A * | 6/2000 | McLoughlin et al. | 340/586 |
| 6,456,261 | B1 * | 9/2002 | Zhang | A42B 3/042 345/7 |
| 2009/0174547 | A1 * | 7/2009 | Greene | A62B 99/00 340/539.13 |

* cited by examiner

*Primary Examiner* — Daryl Pope
(74) *Attorney, Agent, or Firm* — Mark C Jacobs

(57) ABSTRACT

A firefighter's safety apparatus includes a first system located in a firefighter's helmet and a second system located at a central station. The first includes a power source, an ambient temperature sensor for relaying ambient temperature information to a microprocessor, a first on/off light source and a second light source coupled to the microprocessor for emitting a status alarm signal when the temperature sensed is above a preset level. An audible alarm is coupled to the microprocessor for emitting an audio signal when the temperature sensed is above the preset level. A manually operated panic switch causes a transceiver coupled to the microprocessor to send a radio signal to the central station if the firefighter is injured or does not move for a preset time and activates the audio alarm. The second system includes a transceiver, a power source and a microprocessor and a power source electronically coupled.

13 Claims, 2 Drawing Sheets

FIREFIGHTER'S SAFETY MONITORING AND ALARM

BACKGROUND OF THE INVENTION

The present invention relates generally to a firefighter's safety monitoring and alarm apparatus. More particularly, the present invention relates to a firefighter's safety monitoring and alarm apparatus for monitoring various parameters during a firefighter's activities and sending appropriate alarms and other signals to the firefighter and to a central station.

Over the past several years a number of early warning heat detection systems have been devised for indicating to a fireman that the ambient temperature around him is above a predetermined level and that he is in immediate eminent danger. Other systems have also been developed for indicating other possible problems or dangers.

In U.S. Pat. No. 6,310,552 which issued on Oct. 30, 2001 to L. Herbert Stumberg et al, there is disclosed a system which allows the firefighter to monitor a variety of safety related parameters during firefighting activities through audible and/or visual means. The system of the present invention monitors the pressure in the firefighter's breathing system and also monitors ambient temperature and motion of the firefighter. An audible alarm is activated to indicate a potential emergency situation relating to low remaining air time, impending thermal breakthrough or lack of motion of the firefighter.

In U.S. Pat. No. 5,697,099 which issued on Dec. 16, 1987 to William D. Siska, etc. there is disclosed a helmet which is supplied with a personal alarm safety system (PASS) that detects the absence of motion by the wearer. This usually indicates that the user is unconscious or otherwise incapacitated. Also in the helmet is an automatic activation means which turns on the PASS system as soon as the wearer puts on the helmet. Other features such as visual alarm and inactivation means are included in the preferred embodiment. The visual alarm is an LED on the helmet which flashes for assisting searchers to locate the wearer of the helmet when he has fallen or is incapacitated.

In U.S. Pat. No. 4,906,972 which issued on Mar. 6, 1990 to Donald W. Spencer there is disclosed a safety communications system for personnel employed in hazardous areas is responsive to motion sensing, as well as to worker initiated check-in-signals, to register an alarm at a central station after an absence of input for a predetermined time period. Confirmation of check-in and emergency transmission is also provided to the worker as assurance of system operation and to provide a local alarm to guide rescue efforts.

In U.S. Patent Application Publication US2008/0023002A1 which was published on Jan. 31, 2008, in the name of Thomas Kent Guebzon et al. there is disclosed a safety device which includes a protective component wearable on a user's head. The safety device further includes a display unit configured to present status information at a position in the periphery of the field of view of the user. The safety device includes a communications unit connectable to a wireless communication network and configured to send or receive status information. In certain embodiments, the safety apparatus is a breathing apparatus or a head protection device. A method of presenting information to a user is also disclosed.

Accordingly it is an object of this invention to provide a new and improved safety and monitoring alarm apparatus for a firefighter.

A second object is provide a low voltage safety and monitoring system for firemen.

A third object is to provide a communication system between a central station such as a fire truck and the firemen in the field.

A fourth object is to provide a safety system that can discriminate one fireman from another in the field, The invention accordingly comprises the apparatus which possesses the features, properties and the selection of components, as recited in the following detailed disclosure, and the scope of the application of which will be defined in the appended claims.

SUMMARY OF THE INVENTION

A firefighter's safety monitoring and alarm apparatus according to this invention includes a first system located on the firefighter's helmet and a second system at a central location such as a fire chief's truck.

The first system comprises a microprocessor, a power source, a temperature sensor for sensing the ambient temperature around the firefighter and relaying the information to the microprocessor, a first light source coupled to the microprocessor for emitting a visual status signal of one color when the microprocessor system is powered on and working and a second light source coupled to the microprocessor for emitting a visual alarm signal of a second color when the temperature sensed by the temperature sensor is at or above a preset level, the second color being different than the first color. The first system also includes a transceiver, an audible alarm for receiving a signal from the microprocessor when the temperature from the temperature sensor is at or above the preset level for emitting an audio signal in response thereto. A manually operated panic switch which can be activated by the wearer to cause the transceiver to send out a wireless radio frequency signal to the second system at the central location if the firefighter is injured or does not move for a preset time is also present. The second system includes a transceiver for sending out and receiving radio frequency signals to and from the first system and also a power source and a microprocessor to enable the fire chief (truck) to firemen communication.

Various features and advantages will appear from the description to follow. In the description, reference is made to the accompanying drawings which form a part thereof, and in which are shown by way of illustration and for practicing this invention. This embodiment will be described in sufficient detail to enable those skilled in the art to practice the invention. It is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENT

The present invention is directed to a safety apparatus for a firefighter. The apparatus includes a first system and a second system. The first system is located in the firefighter's helmet and includes a temperature sensor for sensing the ambient temperature around the firefighter, an audible alarm, first and second indicator lights, an on/off switch, a reset switch, a voltage source and a microprocessor for controlling the operation of the first system. The second system can be located in the fire chief's truck or other vehicle.

Figure 1:
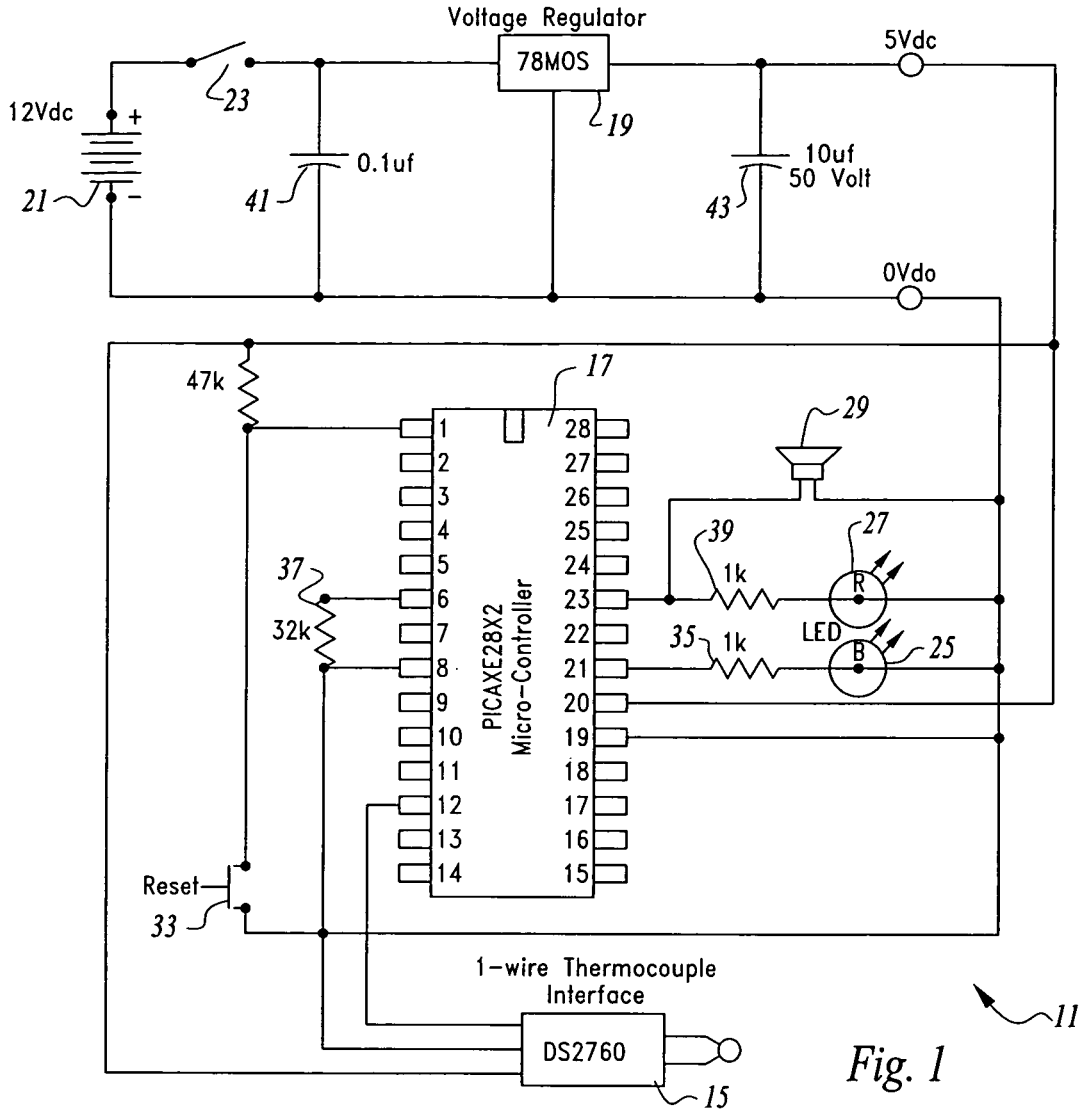
FIG. 1 is an electrical schematic of the components parts of the first system in the apparatus of this invention.
Figure 5:
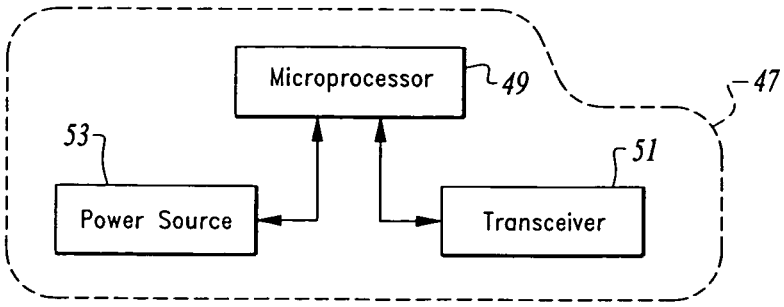
FIG. 5 is a block diagram of the components of the second system of this invention.
Figure 2:
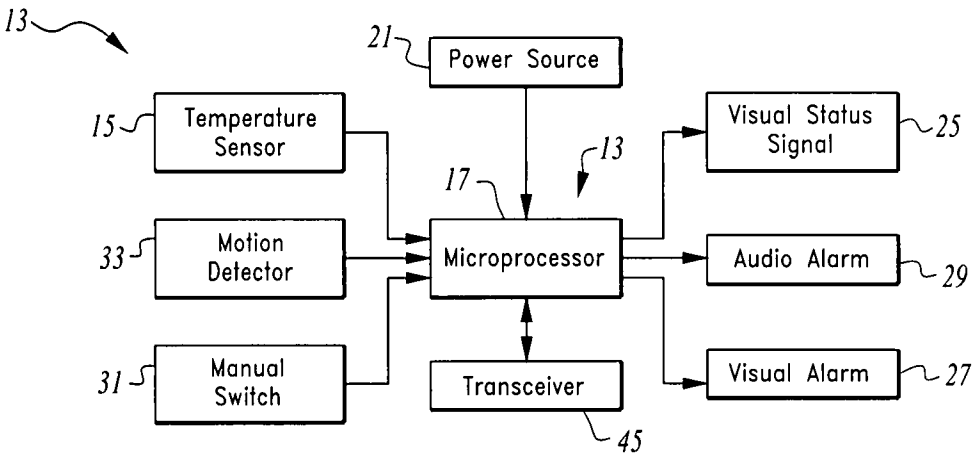
FIG. 2 is a block diagram of the major components in the first system of the apparatus of this invention mounted in a firefighter's helmet.
Figure 3:
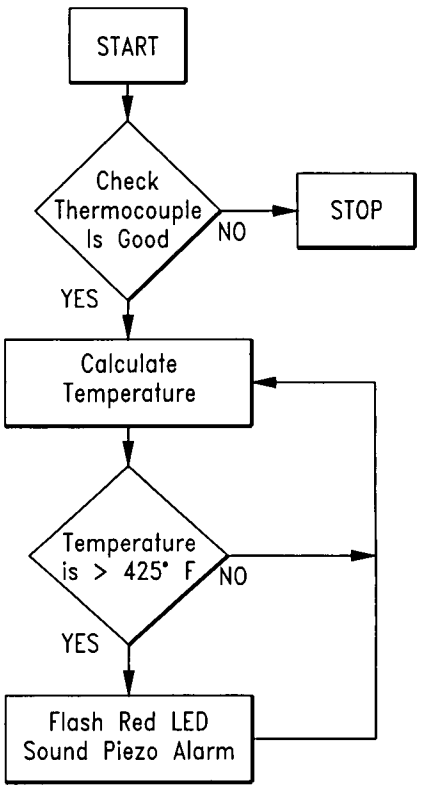
FIG. 3 is a flow chart explaining the operation of the temperature sensor in the system in FIG. 2.

Referring now to the drawings, there is shown in FIG. 1 an electrical schematic of the components in the first system portion of the apparatus of this invention, the first system being identified by reference numeral 11. A block diagram of the major components of first system 11 is shown in FIG. 2 and identified by reference numeral 13 and a flow chart explaining the operation of the temperature sensor in first system 11 is shown in FIG. 3 and identified by reference numeral 12. A simplified sketch showing system 11 as mounted on a firefighter's helmet 14 is shown in FIG. 4 and a block diagram of the second system of the apparatus of this invention is shown in FIG. 5.

Figure 4:
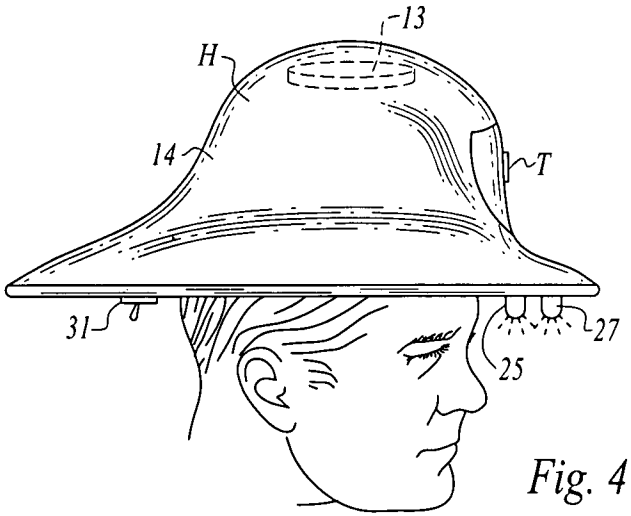
FIG. 4 is a simplified sketch showing the system portion of this invention as mounted on a fireman's helmet.

As can be seen in FIG. 4, the electronics 13 of first system 11 is located in the crown of the fireman's helmet 14.

Referring now back to FIGS. 1 and 2, first system 11 includes a temperature sensor 15, in the form of a T type thermocouple such as a Dollar Semiconductor DS2760, that provides the cold function thermal reference temperature. System 11 also includes a microprocessor 17 in the form of a Picaxe model which runs on 5 volts DC. The 5 volts DC is provided by a 78MO5 voltage regulator 19 which is powered by four 3 volt DC cells 21 connected in series to develop a total of 12 volts DC. An SPST switch 23 turns the voltage ON and OFF to system 11. A visual signal in the form of a green LED 25 flashes at one KH2 to provide a signal that system 11 is powered ON and is working. A second visual signal in the form of a red flashing LED 27 provides a visual alarm and along with an audio alarm in the form of a piezo alarm 29 are both activated when the preset temperature, such, as for example 425F, is reached. Thus, the wearer sees a visual alarm and hears an audio alarm when eminent danger exists.

A manual (panic) switch 31, preferably on the inside right of the bill of the fireman's helmet, see FIG. 4, will activate audio alarm 39 if manually set or will automatically be activated if the firefighter is immobile for a preset time period as indicated by motion detector 44, such as 2 minutes. In either case a wireless signal from transceiver 45 will be sent to a central station that the alarm has been triggered.

Both LED's 25 and 27 are located on helmet H above one eye, such as the right eye of the wearer.

Other components in circuit 11 include a reset switch 33, three resistors 35, 37 and 39 and two capacitors 41 and 43.

Finally, first system 11 includes a transceiver 45 for sending and receiving RF signals. In order to communicate and differentiate between a first fireman and other firemen, the transceiver should be able to operate on a multiplicity of frequencies, with different frequencies assigned to different persons in the field. 19. Such transceivers are within the skill of the art.

Referring now to FIG. 5, there is shown a block diagram of the central station, which may be on the fire chiefs truck. Central station contains the second system 47 and includes a microprocessor 49, a transceiver 51 and a power source 53 coupled together for a person in the fire truck or other vehicle to communicate with any and all firemen who are linked into the first system in the field.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An alarm and status system adapted to be attached to a firefighters helmet comprising:

(A) a microprocessor:

(B) a temperature sensor coupled to the microprocessor for sensing the ambient temperature around a firefighter and relaying the information to the microprocessor:

(C) a first light source coupled to the microprocessor for emitting a visual status signal of a first color as long as the alarm system is powered on and working:

(D) a second light source coupled to the microprocessor for emitting a visual alarm signal of a second color when the temperature sensed by the temperature sensor is at or above a present level;

(E) an audio alarm for receiving a signal from the microprocessor when the temperature from the temperature sensor is at or above the present level and emitting an audio signal in response thereto;

(F) a transceiver couples to said microprocessor for sending out and receiving radio frequency signals;

(G) a panic switch which can be activated manually by the firefighter to send out an audio signal and also can be activated automatically to send out an audio signal if the wearer is immobile or injured or does not move for a present time;

(H) a power source coupled to the microprocessor; and (I) a SPST switch for turning the alarm system on and off.

2. The alarm system of claim 1 wherein the temperature sensor is a thermocouple.

3. The alarm system of claim 2 wherein the thermocouple is set to give out a signal when the ambient temperature rises above 425 F.

4. The alarm system of claim 3 wherein the first light source is an LED.

5. The firefighter's safety monitoring and alarm system of claim 4 wherein the light emitted from the first LED is flashing green.

6. The alarm system of claim 5 wherein the second light source is an LED which emits light of a different color than emitted from the first LED.

7. The alarm system of claim 6 wherein the light emitted the second light source is flashing red.

8. The firefighter's safety monitoring and alarm system of claim 7 wherein the audio alarm is a piezo electric alarm.

9. A firefighter's safety apparatus comprising:

(A) a firefighter's helmet;

(B) a monitoring and alarm system on the helmet, the monitoring and alarm . system including:

(i) a first microprocessor;

(ii) a first transceiver coupled to the microprocessor;

(iii) a power source electrically connected to the microprocessor;

(iv) a pair of light sources each of which can emit light of a different color.

10. An alarm system adapted to be attached to a firefighter's helmet comprising:

(A) a microprocessor;

(B) a temperature sensor for sensing the ambient temperature around the firefighter and relaying the information to the microprocessor;

(C) a first light source coupled to the microprocessor for emitting a visual status signal of a first color when the microprocessor system is powered on and is working;

(D) a second light source coupled to the microprocessor for emitting a visual alarm signal of a second color when the temperature sensed by the temperature sensor is at or above a present level; and (E) an audio alarm for receiving a signal from the microprocessor when the temperature from the temperature sensor is at or above the present level and emitting an audio signal in response thereto.

11. The system of claim 10 wherein the visual status signal is a flashing green signal and the visual alarm signal is a flashing red signal.

12. A firefighter's alarm and status apparatus comprising:

(A) a plurality of first systems each located on a different firefighter's helmet; and (B) a second system located on a fire chief's truck or the like;

(C) each one of said plurality of first systems comprising:

(i) a microprocessor (ii) a temperature sensor for sensing the ambient temperature around the firefighter and relaying the information to the microprocessor;

(iii) a first light coupled to the microprocessor for emitting a visual status signal of a first color when the first system is powered on and working;

(iv) a second light source coupled to the microprocessor for emitting a visual alarm signal of a second color when the temperature by the temperature sensor is at or above a present level;

(v) a transceiver operable on a plurality of frequencies;

(vi) a power source for powering each one of said first systems;

(vii) an audio alarm for receiving a signal from the microprocessor when the temperature is at or above the present level;

(viii) a panic switch which can be activated manually or automatically;

(ix) a visual alarm for emitting a light signal when the temperature sensed is at or above a present level;

(x) a visual status signal indicating the system is powered on and working;

(xi) a manual operated power switch for turning the first system on and off; and (D) said second system comprising:

(i) a transceiver;

(ii) a power source; and (iii) a microprocessor.

13. The system of claim 12 wherein the visual status signal is a flashing green signal and the visual alarm signal is a flashing red signal.

* * * * *